United States Patent [19]

Luursema et al.

[11] Patent Number: 4,588,924

[45] Date of Patent: May 13, 1986

[54] HIGH EFFICIENCY CONVERTER FOR DISCHARGE LAMPS

[75] Inventors: Meerten Luursema; Hilbert Palmers, both of Eindhoven, Netherlands

[73] Assignee: U.S. Philips Corporation, New York, N.Y.

[21] Appl. No.: 628,374

[22] Filed: Jul. 5, 1984

[30] Foreign Application Priority Data

Jul. 13, 1983 [NL] Netherlands ..... 8302498

[51] Int. Cl.[4] ..... H05B 41/36

[52] U.S. Cl. ..... 315/107; 315/106; 315/102; 315/96; 315/210; 315/DIG. 5; 315/DIG. 7

[58] Field of Search ..... 315/106, 107, 102, 96, 315/210, 219, 221, DIG. 5, DIG. 7

[56] References Cited

U.S. PATENT DOCUMENTS 4,256,992 3/1981 Luursema ..... 315/DIG. 7 X

FOREIGN PATENT DOCUMENTS 2460347 6/1976 Fed. Rep. of Germany ..... 315/106
2514321 10/1976 Fed. Rep. of Germany ..... 315/106
607538 12/1978 Switzerland ..... 315/106

*Primary Examiner*—David K. Moore
*Assistant Examiner*—Vincent DeLuca
*Attorney, Agent, or Firm*—Robert T. Mayer; Bernard Franzblau

[57] ABSTRACT

An energization arrangement for a discharge lamp includes a DC/AC converter to which a discharge lamp (81) is connected. The lamp is shunted by a relay contact (90) to obtain an electric circuit through which two electrodes (83, 84) of the lamp can be preheated. It is advantageous to insure that the relay contact is closed before a voltage occurs between the electrodes of the lamp. This prevents the lamp from exhibiting a transient flash at too cold electrodes. A timing circuit (40–47) ensures that the relay contact remains closed for about 1 second, after which the lamp ignites with warm electrodes. No electrical losses occur in the relay winding (30) during operation of the lamp.

12 Claims, 1 Drawing Figure

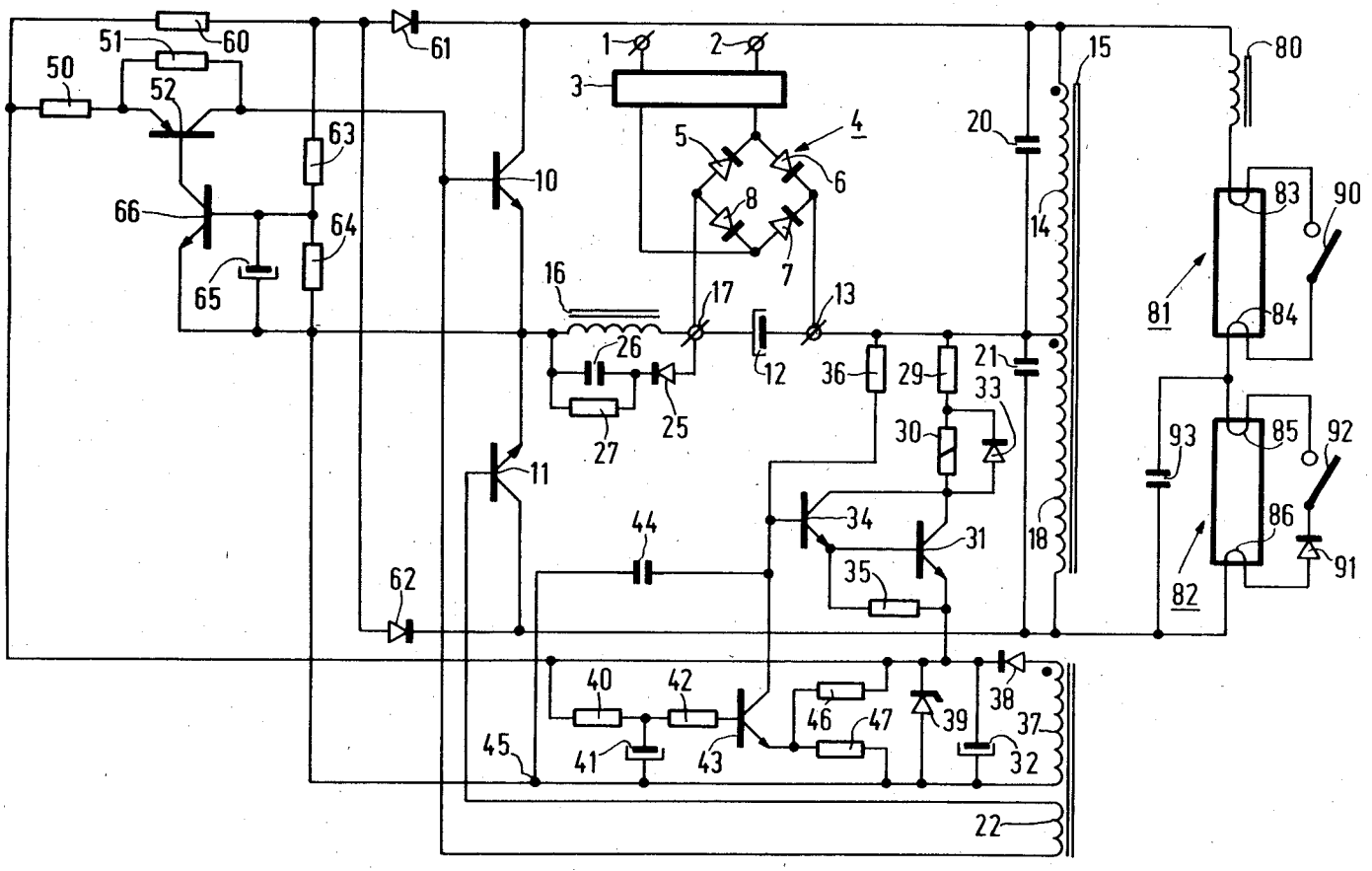
80
81
82
83
84
85
86
90
91
92
93
1
2
3
4
5
6
7
8
10
11
12
13
14
15
16
17
18
20
21
22
25
26
27
29
30
31
32
33
34
35
36
37
38
39
40
41
42
43
44
45
46
47
50
51
52
60
61
62
63
64
65
66

HIGH EFFICIENCY CONVERTER FOR DISCHARGE LAMPS

The invention relates to an arrangement provided with a DC/AC converter for igniting and feeding a gas- and/or vapour discharge lamp comprising preheatable electrodes, in which the converter has a starting circuit and in which in the connected condition of the lamp the ends of the electrodes remote from the converter are connected to each other by means of a circuit comprising a relay contact.

A known arrangement of the aforementioned kind is described, for example, in U.K. patent application No. 2,053,592. This known arrangement has disadvantages which depend upon the type of relay. Either the lamp may exhibit, during ignition, a transient flash while the electrodes are still cold or, in the operating condition of the lamp, electrical losses occur in an energizing winding of the relay. Apart from the annoying effect of the aforementioned transient flash, a lamp ignition with insufficiently preheated electrodes is detrimental to the life of the lamp.

The invention has for an object to provide an arrangement of the kind mentioned in the opening paragraph, in which the aforementioned disadvantages are avoided or are at least reduced.

In an arrangement provided with a DC/AC converter for igniting and feeding a gas- and/or vapour discharge lamp comprising preheatable electrodes, in which the converter has a starting circuit and in which, in the connected condition of the lamp, the ends of the electrodes remote from the converter are connected to each other through a circuit comprising a relay contact, the invention is characterized in that the starting circuit of the DC/AC converter comprises an energizing winding of the relay contact, the relay contact is a make contact and the converter is provided with a timing circuit which controls a switching element in the starting circuit. The time constant of this timing circuit is such that 0.2 to 5 seconds after the converter has been switched on, the switching element interrupts the starting circuit.

Advantages of this arrangement are that it avoids transient flash of a connected lamp with cold electrodes, and no electrical losses occur in the energizing winding of the relay in the operating condition of the lamp.

The invention is based inter alia on the idea to ensure that electrical voltage between the electrodes of the lamp does not occur until the relay contact is closed. In fact, in this case a transient flash—with cold electrodes—is avoided. The invention is further based on the idea to choose a type of relay which is provided with a make contact. In a relay of this type, a current through the energizing winding closes the contact.

An advantage of the relay just mentioned is in fact that the energizing winding does not convey current in the operating condition of the lamp. The relay contact then has to be open in order to avoid a shortcircuit of the lamp. This means that no electrical losses occur in the energizing winding during operation of the lamp. This improves the efficiency of the light production.

The following is also to be noted as to avoiding the transient flash during ignition. When the energizing winding of the relay according to the invention is included in the starting circuit of the DC/AC converter, it is achieved that this winding already receives current before the converter has become operative, that is to say before the voltage between the output terminals of the converter and hence the voltage between the lamp electrodes has occurred. Thus, the closing of the relay contact is leading. As soon as this contact is closed, the lamp in fact is shortcircuited. A transient flash is then no longer possible.

In a preferred embodiment of an arrangement according to the invention, in which the DC/AC converter is a pushpull converter comprising two transistors, the starting circuit of the converter is provided with a capacitor connected in series with the energizing winding of the relay and this capacitor is shunted by a circuit comprising the base-emitter junction of one of the two transistors.

An advantage of this preferred embodiment is that—due to the action of the capacitor in the starting circuit—the instant at which the converter becomes operative is even further delayed. In fact, the capacitor has first to be slightly charged before the voltage thus becoming available renders the relevant transistor sufficiently conductive. This further delay implies that a relay operating at a lower speed can then be used in this arrangement.

In an improvement of the aforementioned preferred embodiment of an arrangement according to the invention, the capacitor of the starting circuit is also shunted by an input circuit of the timing circuit.

An advantage of this improvement is that the feeding voltage for this timing circuit, i.e. the voltage at the capacitor, is produced—anyhow—in a simple manner.

An embodiment of the invention will be described more fully with reference to the accompanying drawing.

The drawing shows an electrical arrangement according to the invention as well as two low-pressure mercury vapour discharge lamps connected to it.

Reference numerals 1 and 2 designate input terminals intended to be connected to an alternating voltage of approximately 220 V, 50 Hz. A filter 3 is connected to the input terminals 1 and 2. Details about the filter are not given. It comprises a few coils and capacitors in order to reduce distortion of the supply current. The filter 3 has connected to it a diode bridge 4 comprising four diodes 5 to 8. A DC/AC converter is connected to the output terminals of the diode bridge 4. This converter is constructed as a pushpull converter provided with two main transistors 10 and 11. Moreover, a smoothing capacitor 12 is connected to the output terminals of the diode bridge 4.

A positive input terminal 13 of the DC/AC converter is connected via a first winding 14 of a transformer 15 to the collector of the transistor 10, which is of the npn type. The emitter of the transistor 10 is connected via an auxiliary coil 16 to a negative input terminal 17 of the DC/AC converter.

The positive input terminal 13 of the converter is further connected via a second winding 18 of the transformer 15 to the collector of the transistor 11, which is also of the npn type. The emitter of the transistor 11 is connected to a junction point between the emitter of the transistor 10 and the auxiliary coil 16.

The transformer winding 14 is shunted by a capacitor 20. The transformer winding 18 is shunted by a capacitor 21. The bases of the transistors 10 and 11 are connected to each other via a winding 22 of the aforementioned transformer 15.

The auxiliary coil 16 is shunted by a series combination of a diode 25 and a capacitor 26. In turn the capacitor 26 is shunted by an auxiliary resistor 27.

This pushpull converter is provided with a starting circuit. This circuit mainly comprises a series combination of a resistor 29, an energizing winding 30 of a relay, a semiconductor switching element 31 and a capacitor 32. This series combination is connected on the one hand to the positive input terminal 13 and on the other hand to a junction point between the emitters of the transistors 10 and 11.

The energizing winding 30 is shunted by a protection diode 33. The switching element 31 is constructed as an npn transistor. The collector of this transistor 31 is connected to the collector of an auxiliary transistor 34. The emitter of this auxiliary transistor 34 is connected to the base of the transistor 31. Furthermore, the base of the transistor 31 is connected to its emitter via a resistor 35. A resistor 36 is connected between the positive input terminal 13 of the converter and the base of the auxiliary transistor 34. Moreover, a further winding 37 of the transformer 15 has one end connected to a diode 38. The other end of the diode 38 is connected to a junction point between the transistor 31 and the capacitor 32. The other end of the winding 37 is connected to the other end of the capacitor 32. The capacitor 32 is shunted by a protection Zener diode 39.

The capacitor 32 is also shunted by an input circuit of a timing circuit. This input circuit is constituted by a resistor 40 connected in series with a capacitor 41. A junction point between the resistor 40 and the capacitor 41 is connected via a resistor 42 to the base of a transistor 43, which is again of the npn type. The collector of this transistor 43 is connected to the base of the transistor 34. The base of the transistor 34 is also connected via a capacitor 44 to a point 45. The point 45 is located on the connection between an end of the transformer winding 37 and a junction point between the emitters of the main transistors 10 and 11.

The emitter of the transistor 43 is connected via a resistor 46 to a junction point between the transistor 31 and the capacitor 32. This emitter of the transistor 43 is further connected via a resistor 47 to the point 45. The capacitor 32 is further shunted by a circuit comprising the base-emitter junction of the transistor 10. This is the circuit comprising a resistor 50, a resistor 51 and a transistor 52 connected parallel thereto, the base-emitter junction of the main transistor 10 as well as the point 45.

A junction point between the capacitor 32 and the resistor 50 is further connected to a resistor 60. The other end of the resistor 60 is connected on the one hand via a diode 61 to the collector of the main transistor 10 and on the other hand via a diode 62 to the collector of the main transistor 11. The last-mentioned end of the resistor 60 is further connected via a series-combination of a resistor 63 and a resistor 64 to the junction point between the emitters of the main transistors 10 and 11. The resistor 64 is shunted by a capacitor 65. A junction point between the resistors 63 and 64 is connected to the base of a transistor 66. The collector of the transistor 66 is connected to the base of the transistor 52. The emitter of the transistor 66 is connected to a junction point between the capacitor 65 and the resistor 64.

The circuit described hitherto comprises an AC/DC part (1 to 8) and a DC/AC converter (10, 11, 13 to 66) with a smoothing capacitor (12).

The combination of the transformer windings 14 and 18 of the frequency converter has connected to it a series arrangement of an inductive stabilization ballast 80, a first discharge lamp 81 and a second discharge lamp 82.

The first discharge lamp 81 is provided with two preheatable electrodes 83 and 84. The lamp 82, which is of the same type as the lamp 81, is also provided with two preheatable electrodes 85 and 86, respectively.

The ends of the electrodes 83 and 84 of the lamp 81 remote from the converter are connected to each other via a make contact 90 of the relay, whose energizing winding is designated by reference numeral 30.

The ends of the electrodes 85 and 86 of the lamp 82 remote from the converter are connected to each other by means of a series-combination of a diode 91 and another make contact 92 of the relay with the energizing winding 30.

Finally, the lamp 82 is shunted by a starting capacitor 93.

The apparatus described with reference to the drawing operates as follows. If the terminals 1 and 2 are connected to the indicated alternating voltage source of 220 V, 50 Hz, the capacitor 12 will be charged. As a result, a small current will flow in the circuit comprising the resistor 36 and the capacitor 44. Consequently, the auxiliary transistor 34 and hence the transistor 31 is rendered conducting. A current will then flow through the starting circuit 29,30,31,32. This means that the relay is energized and the two relay contacts 90 and 92 will be closed. The current flowing in the said circuit 29 to 32 charges the capacitor 32. This means that the voltage across the series-combination of the resistors 63 and 64 is increased. This results in the base of the transistor 66 becoming positive with respect to its emitter so that this auxiliary transistor begins to conduct. In turn this initiates conduction in the transistor 52. As a result, a sufficiently large current can then start flowing via the main electrodes of the transistor 52 through the base-emitter junction of the main transistor 10. The main transistor 10, which then begins to conduct now closes the circuit 13,14,10,16,17, as a result of which a current starts flowing in the primary winding 14 of the transformer 15.

Shortly afterwards the main transistor 10 is cut-off and the transistor 11 begins to conduct due to the action of the transformer winding 22. Thus, a current starts flowing in the winding 18 of the transformer. Due to the action of the aforementioned winding 22, the two main transistors 10 and 11 then again become alternately conducting. This produces a high-frequency voltage across the series-combination of the ballast 80 and the lamps 81 and 82.

Due to the action of the starting circuit 29 to 32, the contacts 90 and 92 have already been closed before the voltage occurs across this series-combination 80 to 82. The said high-frequency voltage will lead (after its occurrence) a current through the circuit 86,91,92,85,84,90,83 and 80. This current causes the temperature of the four electrodes 83 to 86 to increase. The presence of the diode 91 reduces the effective value of the ballast 80 and thus increases the preheating current of the electrodes.

About one second after the input terminals 1 and 2 have been connected to the voltage source, the timing circuit 40 to 47 renders the auxiliary transistor 34 non-conducting by initiating conduction in the transistor 43. This results in the cut-off of transistor 31. This means an interruption of the starting circuit of the DC/AC converter, i.e. 0.2 to 5 seconds after the converter has been switched on. This has a double result. In the first place, the relay contacts 90 and 92 are opened. Subsequently, the two lamps 81 and 82 are ignited. The second effect of the transistor 31 becoming non-conducting is that the starting circuit is switched off so that no electrical energy is lost during the further operation of the lamps 81 and 82, either in the resistor 29 or in the energizing winding 30 of the relay.

An advantage of the apparatus described is that the lamps do not exhibit a transient flash at cold electrodes because the contacts 90 and 92 are closed in time. A further advantage is that—as stated—no electrical losses occur in the starting circuit during the operating condition of the lamps 81 and 82.

In a practical embodiment, the auxiliary coil 16 is about 13 mHenry; and

Coil 80: about 10 mHenry
Capacitor 12: about 47 μFarad
Capacitor 20: about 18 nFarad
Capacitor 21: about 18 nFarad
Capacitor 26: about 220 nFarad
Capacitor 32: about 330 μFarad
Capacitor 41: about 6.8 μFarad
Capacitor 44: about 10 nFarad
Capacitor 65: about 22 μFarad
Capacitor 93: 1.8 nFarad
Resistor 27: about 1 MΩ
Resistor 29: about 3.9 kΩ
Resistor 35: about 560Ω
Resistor 36: about 1.2 MΩ
Resistor 40: about 120 kΩ
Resistor 42: about 39 kΩ
Resistor 46: about 560Ω
Resistor 47: about 1000Ω
Resistor 50: about 33Ω
Resistor 51: about 560Ω
Resistor 60: about 1000Ω
Resistor 63: about 2200Ω
Resistor 64: about 1200Ω

In this case, the output voltage of the converter is about 350 V and the output frequency is about 25 kHz.

Each of the lamps is a 50 W lamp and has a diameter of about 26 mm. The luminous flux of each of the lamps is about 5200 lumen.

The system efficacy of the whole apparatus is about 92 lumen/W.

What is claimed is:

1. An arrangement comprising a DC/AC converter for igniting and feeding a discharge lamp having preheatable electrodes, the converter including a starting circuit and in which, in the connected condition of the lamp, the ends of the lamp electrodes remote from the converter are connected to each other by means of a circuit comprising a relay make contact, wherein the starting circuit of the DC/AC converter comprises an energizing winding of the relay contact, the converter having a timing circuit which controls a switching element in the starting circuit, the time constant of the timing circuit being such that 0.2 to 5 seconds after the converter has been switched on, the switching element interrupts the starting circuit.

2. An arrangement as claimed in claim 1, wherein the DC/AC converter comprises a push-pull converter having two transistors, characterized in that the starting circuit of the converter comprises a capacitor connected in series with the energizing winding of the relay and said capacitor is shunted by a circuit comprising the base-emitter junction of one of the two transistors.

3. An arrangement as claimed in claim 2, characterized in that the capacitor of the starting circuit is also shunted by an input circuit of the timing circuit.

4. Apparatus for energizing an electric discharge lamp having preheatable electrodes comprising: a pair of input terminals for a source of DC supply voltage, a DC/AC converter coupled to the input terminals and having an output for supplying a high-frequency voltage to a discharge lamp via a ballast device, said DC/AC converter including a starting circuit coupled to the input terminals and having a relay energizing winding with a normally open contact connectable to the lamp electrodes so as to provide preheat current path for the lamp electrodes when the relay contact is closed, said starting circuit including a switching element for controlling current flow in the energizing winding so as to allow the relay contact to close when the apparatus is switched on, and a timing circuit coupled to the switching element for operating the switching element a given time after the apparatus is switched on so as to interrupt the current flow in the energizing winding and open said relay contact to promote lamp ignition.

5. Apparatus as claimed in claim 4 wherein the DC/AC converter includes at least one semiconductor element with a control electrode and the starting circuit includes a capacitor for developing a voltage that controls the operation of the timing circuit, said capacitor being coupled to the semiconductor control electrode so as to delay the operation of the DC/AC converter after switch-on such that the relay contact can be closed prior to operation of the DC/AC converter to allow a preheat current to flow in the lamp electrodes for a time period sufficient to heat the electrodes to approximately operating temperature before the converter supplies a voltage at its output sufficient to ignite a lamp.

6. Apparatus as claimed in claim 5 wherein the capacitor voltage controls the switching element via the timing circuit to interrupt the starting circuit but not before the relay contact is opened.

7. Apparatus as claimed in claim 4 wherein the starting circuit includes a capacitor for developing a voltage that controls the switching element to interrupt the starting circuit when the relay contact is opened thereby to eliminate losses in the starting circuit when the lamp is in the operating condition.

8. Apparatus as claimed in claim 4 wherein the DC/AC converter includes a semiconductor element with a control electrode and the starting circuit includes a capacitor connected in series circuit with the energizing winding, said switching element allowing a current to flow in said series circuit upon switch-on of the apparatus, and means coupling the capacitor to the semiconductor control electrode such that conduction of the semiconductor element is delayed after switch-on whereby operation of the DC/AC converter is delayed to inhibit the production of a voltage at the output of the DC/AC converter for a time period sufficient to allow a preheat current in the lamp electrodes to heat said electrodes.

9. Apparatus as claimed in claim 8 wherein the switching element is also connected in the series circuit in series with the energizing winding and the capacitor, the timing circuit being responsive to the capacitor voltage to cut-off the switching element said given time after switch-on so as to interrupt the starting circuit in the operating condition of the lamp.

10. Apparatus as claimed in claim 4, wherein the DC/AC converter comprises first and second transistor devices connected in push-pull, a transformer having a primary winding coupled to said first and second transistor devices and to at least one capacitor to form an LC circuit that determines the converter frequency, and said starting circuit includes a capacitor connected in series circuit with the energizing winding for developing a voltage that controls the operation of the timing circuit and also controls the operation of at least one of the transistor devices, and said transformer includes a secondary winding coupled to control electrodes of the first and second transistor devices to alternately switch the transistor devices on and off in mutually exclusive time intervals.

11. Apparatus as claimed in claim 10 wherein the switching element is also connected in said series circuit with the capacitor and the energizing winding, said switching element allowing current to flow in the series circuit upon switch-on and interrupting current flow therein in the operating condition of the lamp, and wherein the transformer includes a further secondary winding coupled to the capacitor via a diode.

12. Apparatus as claimed in claim 4 further comprising a diode connectable in series with the relay contact across the lamp electrodes as part of said preheat current path.

* * * * *